US011035565B1

(12) United States Patent
Levy

(10) Patent No.: US 11,035,565 B1
(45) Date of Patent: Jun. 15, 2021

(54) FLAG TOPPER

(71) Applicant: Arthur Levy, Wynnewood, PA (US)

(72) Inventor: Arthur Levy, Wynnewood, PA (US)

(73) Assignee: ONENATION FLAG LLC., Wynnewood, PA (US)

( * ) Notice: Subject to any disclaimer, the term of this patent is extended or adjusted under 35 U.S.C. 154(b) by 0 days.

(21) Appl. No.: 17/065,023

(22) Filed: Oct. 7, 2020

Related U.S. Application Data

(60) Provisional application No. 62/945,280, filed on Dec. 9, 2019.

(51) Int. Cl.

| | |
|---|---|
| ***F21V 33/00*** | (2006.01) |
| ***F21S 9/03*** | (2006.01) |
| ***F21S 8/08*** | (2006.01) |
| ***G09F 13/02*** | (2006.01) |
| ***G09F 17/00*** | (2006.01) |
| ***E04H 12/32*** | (2006.01) |
| ***F21Y 115/10*** | (2016.01) |
| ***F21W 121/00*** | (2006.01) |

(52) U.S. Cl.
CPC ..... *F21V 33/00* (2013.01); *F21S 8/085* (2013.01); *F21S 9/035* (2013.01); *G09F 13/02* (2013.01); *G09F 17/00* (2013.01); *E04H 12/32* (2013.01); *F21W 2121/00* (2013.01); *F21Y 2115/10* (2016.08)

(58) Field of Classification Search
CPC .. F21S 8/083; F21S 8/085; F21S 8/088; F21S 9/035; F21S 9/037; F21W 2131/00; F21W 2121/00
See application file for complete search history.

(56) References Cited

U.S. PATENT DOCUMENTS

| | | | | |
|---|---|---|---|---|
| 3,752,975 | A * | 8/1973 | Meyer | E04H 12/32 362/253 |
| 8,215,807 | B1 | 7/2012 | Brunesti | |
| 9,915,408 | B2 * | 3/2018 | Kao | F21S 9/037 |
| 10,808,913 | B1 * | 10/2020 | Pitcher | F21V 7/06 |
| 2004/0134411 | A1 | 7/2004 | Lawrence | |

(Continued)

FOREIGN PATENT DOCUMENTS

| | | |
|---|---|---|
| CN | 303567278 S | 1/2016 |
| CN | 305143185 S | 5/2019 |
| CN | 305218479 S | 6/2019 |

*Primary Examiner* — Alexander K Garlen
(74) *Attorney, Agent, or Firm* — Gearhart Law LLC

(57) ABSTRACT

A finial assembly affixed to a flagpole is described. The assembly includes a mounting component configured to receive the flagpole therein, a base component having transparent sections, a body component having solar panels, and a top component having transparent portions. The body component includes a hollow interior having an upper cavity that houses a first support structure and receives the top component and a lower cavity that houses a second support structure. Each of the first and second support structure are associated with a light-emitting diode (LED) operatively connected to the solar panels. A first LED of the first support structure illuminates light towards the transparent portions of the top component and a second LED of the second support structure illuminates light towards the transparent sections of the base component to illuminate a flag affixed to the flagpole.

13 Claims, 16 Drawing Sheets

(56) References Cited

U.S. PATENT DOCUMENTS

| | | | | |
|---|---|---|---|---|
| 2005/0083693 | A1* | 4/2005 | Garrett | G09F 17/00 362/253 |
| 2008/0013306 | A1* | 1/2008 | Guilmette | G09F 17/00 362/183 |
| 2012/0314404 | A1* | 12/2012 | Harshaw | F21V 7/0025 362/183 |
| 2016/0348863 | A1 | 12/2016 | Toner | |
| 2017/0152998 | A1 | 6/2017 | Toner | |
| 2018/0013306 | A1 | 1/2018 | Tkachenko | |
| 2019/0360650 | A1 | 11/2019 | Toner | |
| 2020/0116319 | A1 | 4/2020 | Gallo, Jr. | |

* cited by examiner

100

FLAG TOPPER

CROSS-REFERENCE TO RELATED APPLICATIONS

This is a Non-Provisional Patent Application that claims priority to U.S. Provisional Patent Application Ser. No. 62/945,280, filed on Dec. 9, 2019, the contents of which are hereby fully incorporated by reference in its entirety.

FIELD OF THE EMBODIMENTS

The field of the invention and its embodiments relate to a flag topper. In particular, the field of the invention and its embodiments relate to a finial assembly (or a distinctive ornament) at the apex of a flagpole and configured to illuminate a flag affixed to the flagpole.

BACKGROUND OF THE EMBODIMENTS

Homes, businesses, and governmental entities choose to fly flags for patriotic purposes or to welcome others. However, at night, most flags are not visible. U.S. Flag Code Requirement § 174(a) provides, in part, "[h]owever, when a patriotic effect is desired, the flag may be displayed twenty-four hours a day if properly illuminated during the hours of darkness." To comply with the U.S. Flag Code, some businesses, homeowners, and governmental agencies shine ground lights on the flag so that the flag may be illuminated at night. However, if weather conditions, such as wind, occur, the flag may still not be visible with use of ground lights. Additionally, if there is little to no wind, the ground light may also fail by casting only some light on the flag, making the flag color and appearance difficult to view.

To address these concerns, some attempt to illuminate flags through use of a device mounted on the top of a flagpole that include a lighting component or fixture. However, such component may be inoperable during adverse weather and environmental conditions. Thus, there is a need for a means to illuminate a flag during the night, regardless of whether any adverse weather and/or environmental conditions exist.

Examples of related art include:

U.S. Pat. No. 8,215,807 B1 describes a flagpole and light combination assembly that includes a pole having a top end. A light emitter is attached to the pole. A power source is electrically coupled to the light emitter and comprises a rechargeable battery mounted in the pole. A solar panel is electrically coupled to the rechargeable battery. The solar panel is mounted on the pole. A connecting apparatus releasably connects the flag to the pole and positions the flag adjacent to the light emitter. The light emitter is spaced from the top end of the pole to emit light laterally of the pole and onto the flag. The connecting apparatus includes an upper flag coupler and a lower flag coupler spaced from each other. The light emitter is positioned between the upper and lower flag couplers and emits light orthogonally to the pole to illuminate the flag.

U.S. Published Patent Application No. 2020/0116319 A1 describes a solar-powered flag light. The light is designed to be affixed to a flagpole or flag stand, thereby illuminating the flag for easy viewing. The solar-powered flag light includes an elongated housing having an exterior surface and an interior surface. The elongated housing has an arcuate shape. The interior surface includes a channel that is configured along a central axis designed to receive a pole therein. A plurality of lights are located along the interior surface and a plurality of solar cells are disposed along the exterior surface. At least one power source is within the housing and operably connected to the plurality of lights and the plurality of solar cells, such that the solar cells power the lights. In this way, a user is able to illuminate a flag, such that individuals may easily view the flag.

U.S. Published Patent Application No. 2008/0013306 A1 describes an illumination device that is mounted on the distal end of a flagpole and illuminates a flag displayed during periods of darkness to conform with common flag etiquette procedures. The illumination device is powered by batteries during an illumination mode of operation during periods of darkness.

U.S. Published Patent Application No. 2004/0134411 A1 describes an environmentally friendly beacon or light for illuminating a pole-mounted, halyard-hoisted flag, banner, pennant or the like that has a luminous source located in a cover, is mounted on top of the pole, and is capable of continuously directing a narrow beam of light toward the flag, banner, pennant or the like as the wind blows the same around the pole.

U.S. Published Patent Application No. 2019/0360650 A1 describes a lighting unit. The lighting unit has a housing. The housing has a base portion that has a surrounding wall. The housing has a solar panel support portion that is supported on the base portion. A solar panel is mounted on the solar panel support portion and energy gathered by the solar panel is stored in a rechargeable battery. The base portion has a base wall and a surrounding wall, and the surrounding wall may have a cylindrical shape, a conical shape, or an inverted conical shape. Surface mounted lights may be mounted on any surface of the lighting unit and can be in any shape or pattern. A base recess may be formed in the base wall and supports a recessed LED. A recess wall may be formed in the surrounding wall and supports a recessed LED. The surface mounted and recessed LEDs are for illuminating a flag or flagpole finial.

U.S. Published Patent Application No. 2017/0152998 A1 describes a flagpole finial assembly. The assembly is provided for lighting of a flag suspended from the flagpole. The flagpole finial assembly has a cover final half that is supported on a base finial half. The base finial half has a base finial half inner surface and an opposed base finial half outer surface. The base finial half is formed with a LED support wall or a plurality of LED support walls that extend into the base finial half and that define LED recesses. Each LED support wall defines a light opening into which a LED is fitted such that the LED extends from the base finial half and is disposed in the LED recess. The LEDs are wired to a power cord that extends through the flagpole and exits the flagpole. The power cord is powered via a power adapter or a solar panel wired to a rechargeable battery pack.

U.S. Published Patent Application No. 2016/0348863 A1 describes a lighting unit. The lighting unit has a housing with a lighting portion and a solar panel portion. Solar panels are mounted on the solar panel portion and energy gathered by the solar panels is stored in a rechargeable battery. The lighting portion has a conical shaped wall that meets with a circular shaped wall. Each of the conical shaped wall and circular shaped wall defines light recesses defined by light recess walls. An LED is disposed in each recess. The LEDs are powered by the rechargeable battery and are capable of illuminating a flag whether or not there is a breeze or wind. The circular shaped wall defines a wall opening and the solar panel portion has a pole extension that is fitted in the wall opening. A flagpole extends through the pole extension and the lighting unit is mounted on the flagpole.

CN3052184795, CN3035672785, and CN305143185S describe a solar flagpole lamp.

Some flag topper devices exist in the art. However, their means of operation are substantially different from the present disclosure, as the other inventions fail to solve all the problems taught by the present disclosure.

SUMMARY OF THE EMBODIMENTS

The present invention and its embodiments relate to a flag topper. In particular, the field of the invention and its embodiments relate to a finial assembly (or a distinctive ornament) at the apex of a flagpole and configured to illuminate a flag affixed to the flagpole.

A first embodiment of the present invention describes a finial assembly affixed to a flagpole and configured to illuminate a flag affixed to the flagpole. It should be appreciated that the finial assembly may be affixed to another object besides a flagpole, such as a fence post to illuminate a fence or an object proximate the ground to illuminate a driveway or a walkway, among other examples not explicitly listed herein. The finial assembly includes a mounting component, a base component, a body component, and a top component. In some examples, the top component is clear or transparent. In other examples, the top component comprises a clear or a transparent portion. In further examples, the top component includes a glass material or a translucent thermoplastic material. The base component includes one or more clear or transparent sections. In some examples, the one or more clear or transparent sections are windows.

The mounting component includes an opening. The opening is configured to receive the flagpole therein and affix the finial assembly to the flagpole. The base component is positioned between the body component and the mounting component. A width of the mounting component is less than a width of the body component. In this example, a shape of each of the base component and the body component is a hexagonal shape such that each of the base component and the body component comprise six walls. However, it should be appreciated that the shape of each of the base component and the body component is not limited to such shape and other shapes are contemplated.

The base component radiates outward from the mounting component. An angle between the mounting component and the base component is an obtuse angle. The body component is positioned between the base component and the top component. The body component includes: at least one solar panel, an exterior surface disposed opposite an interior surface, and a hollow interior. The hollow interior includes an upper cavity and a lower cavity. The upper cavity is configured to house a first support structure for a first light-emitting diode (LED) and is configured to receive the top component. The lower cavity is configured to house a second support structure for a second LED. The top component is seated in the upper cavity of the body component.

Each of the first LED and the second LED are operatively connected to the at least one solar panel of the body component. Further, the hollow interior of the body component also includes at least one battery pack configured to accumulate electrical power from the at least one solar panel. The at least one battery pack is operatively connected to the first LED, the second LED, and/or one or more other LEDs.

The first LED of the first support structure is configured to illuminate light towards the top component. The second LED of the second support structure is configured to illuminate light towards the one or more clear or transparent sections of the base component to illuminate the flag.

A second embodiment of the present invention describes a finial assembly affixed to a flagpole and configured to illuminate a flag affixed to the flagpole. The finial assembly includes a mounting component, a base component, a body component, and a top component. The top component includes at least one clear or a transparent portion. Furthermore, the top component includes a glass material or a translucent thermoplastic material. The mounting component includes an opening. The opening is configured to receive the flagpole therein and affix the finial assembly to the flagpole.

The base component is positioned between the body component and the mounting component. A shape of each of the base component and the body component is a hexagonal shape such that each of the base component and the body component comprise six walls. The base component includes one or more clear or transparent sections and is configured to radiate outward from the mounting component.

The body component is positioned between the base component and the top component. The body component includes at least one solar panel, an exterior surface disposed opposite an interior surface, and a hollow interior. The hollow interior includes an upper cavity and a lower cavity. The upper cavity is configured to house a first support structure for a first LED. The upper cavity is also configured to receive the top component. The lower cavity is configured to house a second support structure for a second LED. The top component is seated in the upper cavity of the body component.

Specifically, the first LED of the first support structure is configured to illuminate light towards the top component and the second LED of the second support structure is configured to illuminate light towards the one or more clear or transparent sections of the base component to illuminate the flag. The hollow interior of the body component further includes at least one battery pack configured to accumulate electrical power from the at least one solar panel. The at least one battery pack is operatively connected to the first LED, the second LED, and/or one or more other LEDs.

A third embodiment of the present invention describes a finial assembly affixed to a flagpole and configured to illuminate a flag affixed to the flagpole. The finial assembly includes numerous components, such as: a mounting component, a base component, a body component, and a top component. The mounting component includes an opening. The opening receives the flagpole therein and affix the finial assembly to the flagpole. The top component includes at least one clear or a transparent portion.

The base component is positioned between a body component and the mounting component. The base component has a hexagonal shape and includes one or more clear or transparent sections. The base component radiates outward from the mounting component. The body component is positioned between the base component and a top component. The body component has the hexagonal shape and includes: at least one solar panel, an exterior surface disposed opposite an interior surface, and a hollow interior.

The hollow interior includes an upper cavity and a lower cavity. The upper cavity is configured to house a first support structure for a first LED. The upper cavity is also configured to receive the top component. The lower cavity is configured to house a second support structure for a second LED and at least one battery pack. The top component is seated in the upper cavity of the body component. The first LED associated with the first support structure is configured to illuminate light towards the top component. The second LED associated with the second support structure is configured to illuminate light towards the one or more clear or transparent sections of the base component to illuminate the flag. The at least one battery pack is configured to accumulate electrical power from the at least one solar panel. The at least one battery pack is operatively connected to the first LED, the second LED, and/or one or more other LEDs.

In general, the present invention succeeds in conferring the following benefits and objectives.

It is an object of the present invention to provide a finial assembly meeting U.S. Flag Code Requirement § 174(a).

It is an object of the present invention to provide a finial assembly that illuminates a flag during nighttime.

It is an object of the present invention to provide a finial assembly that illuminates a flag during nighttime regardless of adverse weather and/or environmental conditions.

It is an object of the present invention to provide a finial assembly that illuminates a flag during nighttime and illuminates a top component or sculptured shape of the finial assembly at the same time.

DESCRIPTION OF THE PREFERRED EMBODIMENTS

Figure 1:
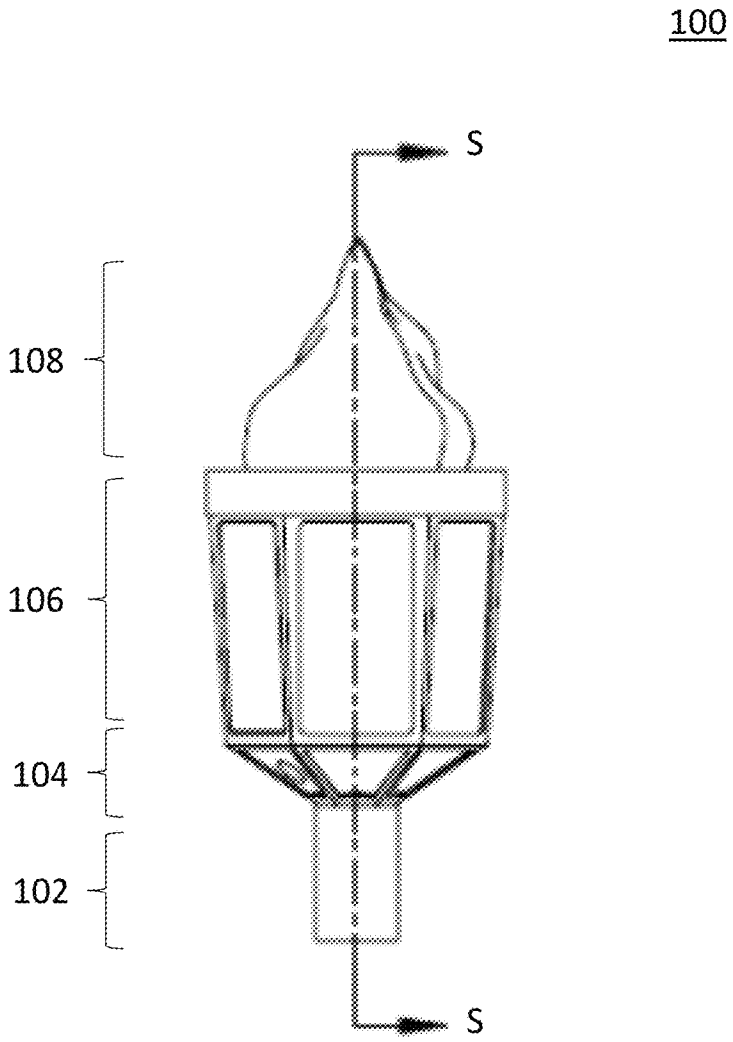
FIG. 1 depicts a perspective view of a schematic diagram of a finial assembly, according to at least some embodiments disclosed herein.

The preferred embodiments of the present invention will now be described with reference to the drawings. Identical elements in the various figures are identified with the same reference numerals. Reference will now be made in detail to each embodiment of the present invention.

Such embodiments are provided by way of explanation of the present invention, which is not intended to be limited thereto. In fact, those of ordinary skill in the art may appreciate upon reading the present specification and viewing the present drawings that various modifications and variations can be made thereto.

Figure 11:
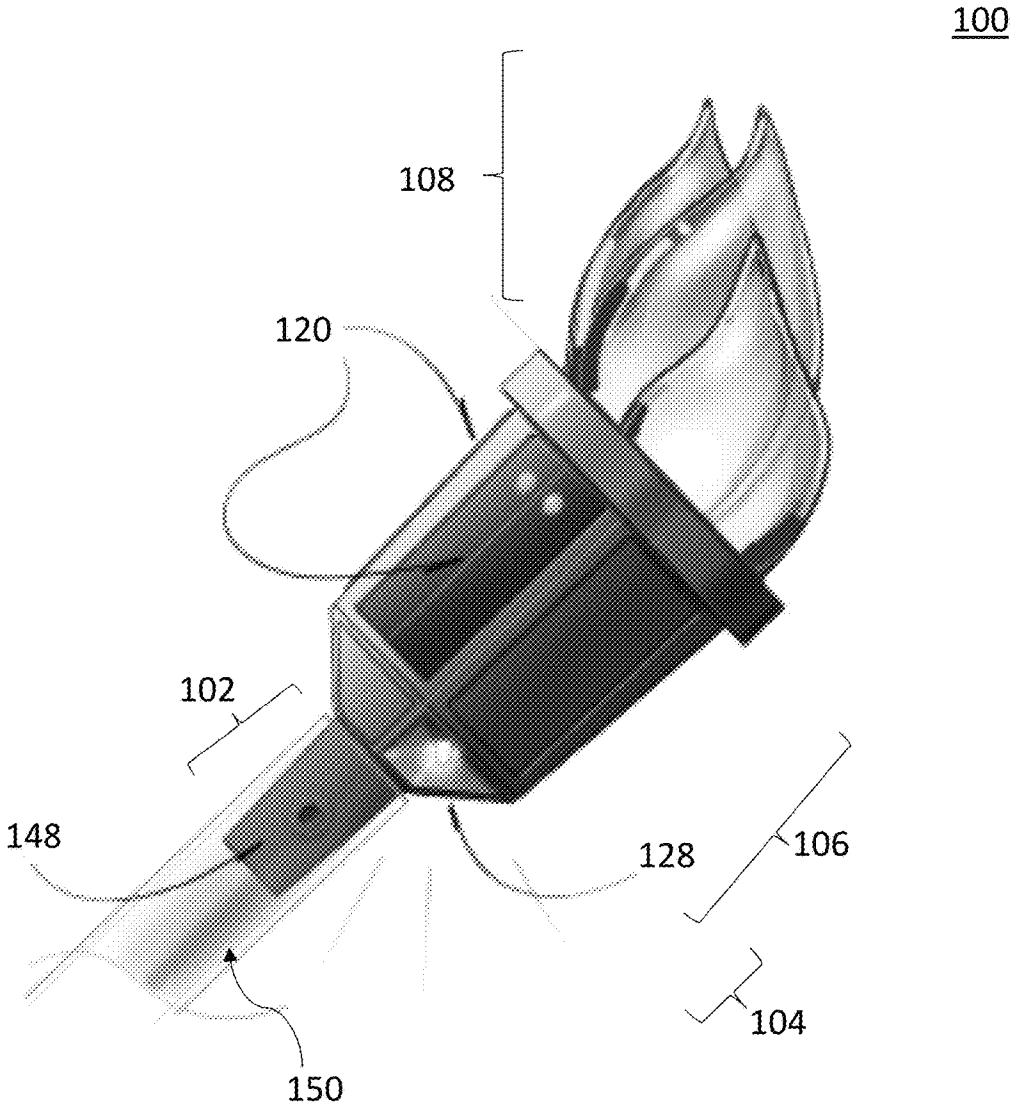
FIG. 11 depicts a perspective view of a schematic diagram of a finial assembly having a tapered mounting component, according to at least some embodiments disclosed herein.

U.S. Flag Code Requirement § 174(a) provides, in part, "[h]owever, when a patriotic effect is desired, the flag may be displayed twenty-four hours a day if properly illuminated during the hours of darkness." A finial assembly 100 (or a distinctive ornament or lighting attachment) affixed at an apex of a flagpole 150 (of FIG. 11 and FIG. 13) is described and depicted herein. The finial assembly 100 is configured to illuminate a flag affixed to the flagpole 150. Moreover, the finial assembly 100 complies with U.S. Flag Code Requirement § 174(a). In examples, a shape of the finial assembly 100 is symmetrical about the "S" line, as shown in FIG. 1. The finial assembly 100 includes multiple components, such as a mounting component 102, a base component 104, a body component 106, and a top component 108.

In a first embodiment, the mounting component 102 includes an opening 144 (of FIG. 3, FIG. 4, FIG. 5, FIG. 6, FIG. 7, FIG. 8, and FIG. 9). The opening 144 of the mounting component 102 is configured to receive the flagpole 150 therein and is configured to affix the finial assembly 100 to the flagpole 150. In examples, the mounting component 102 is substantially cylindrical in shape. However, the shape of the mounting component 102 is not limited to such and other shapes are contemplated.

In another embodiment, the mounting component 102 comprises a tapered end 148 (of FIG. 11 and FIG. 13) such that the tapered end 148 is received by an opening of the flagpole 150 to affix the finial assembly 100 to the flagpole 150.

The base component 104 is positioned between the body component 106 and the mounting component 102. In some examples, the base component 104 radiates outward from the mounting component 102 and towards the top component 108. In these examples, an angle between the mounting component 102 and the base component 104 is an obtuse angle.

Figure 12:
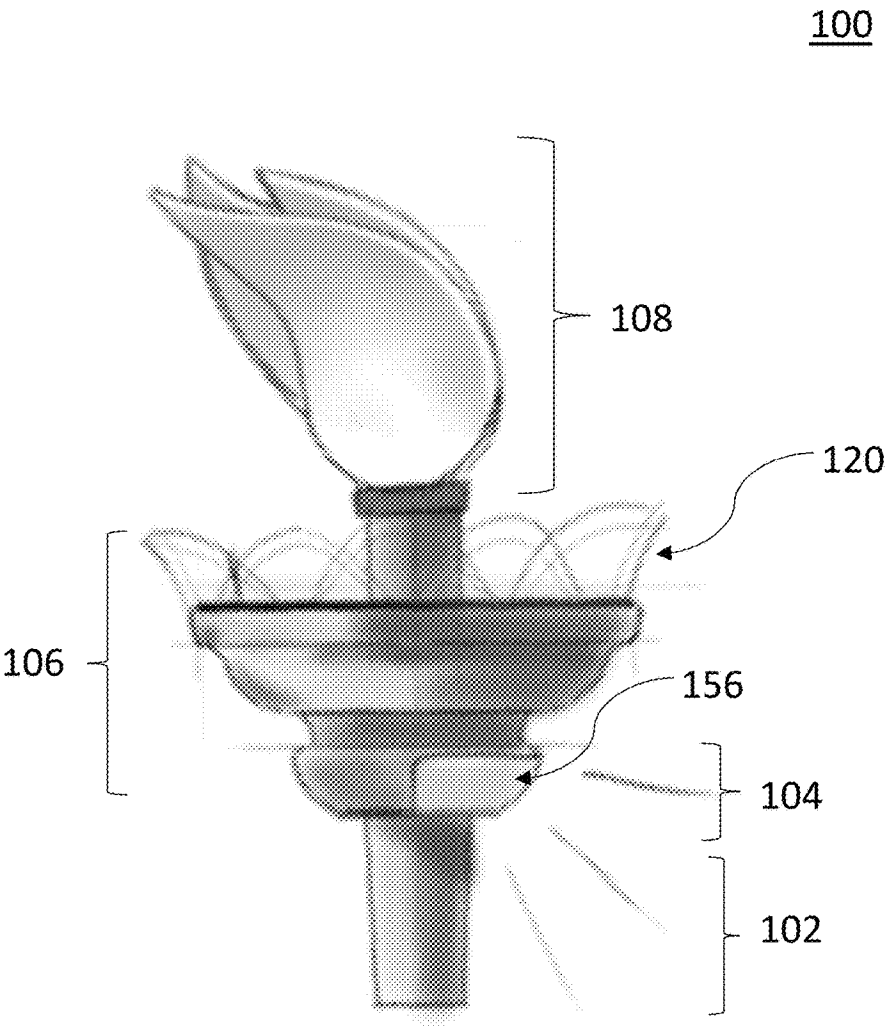
FIG. 12 depicts a perspective view of a schematic diagram of a finial assembly having another embodiment of a body component, according to at least some embodiments disclosed herein.

In a first example, a shape of the base component 104 is a hexagonal shape such that the base component 104 has six walls or sides of equal shape and size. In another example, and as depicted in FIG. 12, the shape of the base component 104 is a torus shape. In this example of FIG. 12, the base component 104 comprises at least one transparent portion 156. One or more LED's may illuminate light through the at least one transparent portion 156. The body component 106, as shown in FIG. 12, includes at least one solar panel 120. The at least one solar panel 120 is configured to receive and store the sun's energy during the day. However, it should be appreciated that the shape of the base component 104 and the shape of the body component 106 is not limited to such shape and other shapes are contemplated.

A width of the mounting component 102 is less than a width of the body component 106. In an example, a shape of body component 106 is a hexagonal shape such that body component 106 comprise six walls. However, it should be appreciated that the shape of the body component 106 is not limited to such shape and other shapes are contemplated. For example, in other embodiments and as depicted in FIG. 12, the shape of the body component 106 may comprise a saucer or a cup shape.

Figure 15:
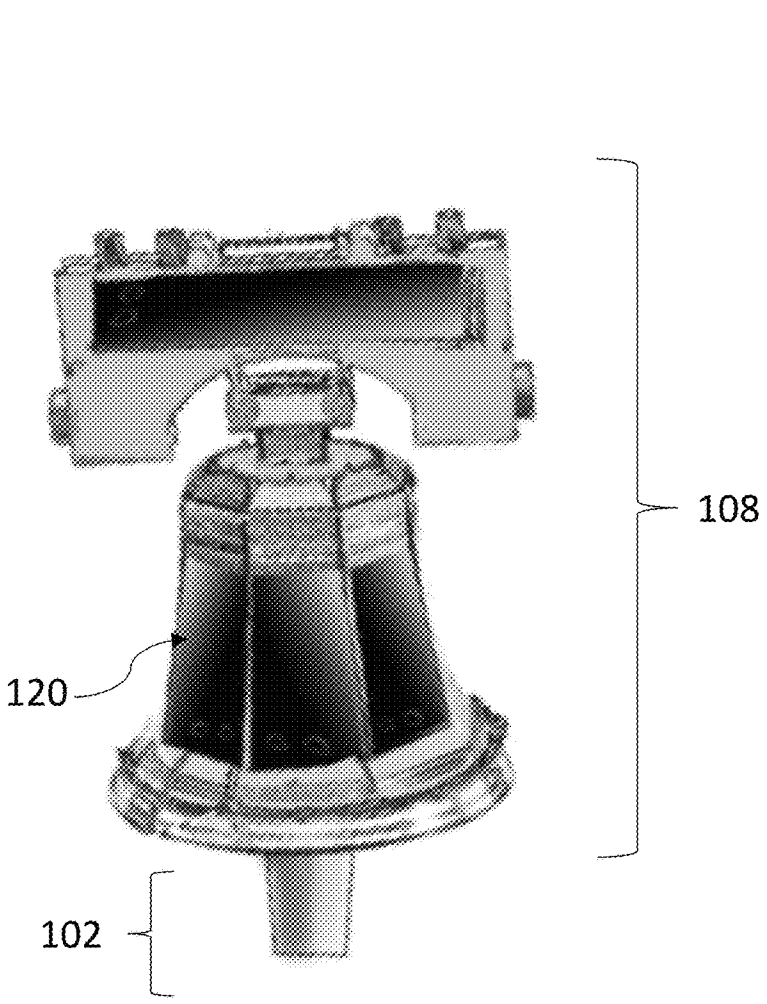
FIG. 15 depicts a perspective view of a schematic diagram of a second side of a finial assembly having a bell-shaped top component, according to at least some embodiments disclosed herein.

The body component 106 is positioned between the base component 104 and the top component 108. Differing from the embodiment of FIG. 12, the body component 106 of at least FIG. 3, FIG. 11, FIG. 13, and FIG. 15 includes: the at least one solar panel 120 (of FIG. 3), an exterior surface disposed opposite an interior surface, and a hollow interior. It should be appreciated that a quantity of the at least one solar panel 120 is not limited to any particular quantity. Moreover, in some examples, the at least one solar panel 120 may replace an entirety of a wall of the body component 106. The at least one solar panel 120 of FIG. 15 is configured to face the sun and receive and store the sun's energy during the day.

The hollow interior of the body component 106 includes an upper cavity configured to house at least a first support structure 122 for a first LED 124 (of FIG. 6, FIG. 7, FIG. 8, and FIG. 9). The upper cavity of the body component 106 is also configured to receive the top component 108. In some examples, the top component 108 is seated in the upper cavity of the body component 106. In some examples, the top component 108 is clear or transparent. In other examples, the top component 108 comprises a clear or a transparent portion. In further examples, the top component 108 includes a glass material or a translucent thermoplastic material. However, it should be appreciated that the top component 108 may comprise one or more other materials not explicitly listed herein.

Figure 13:
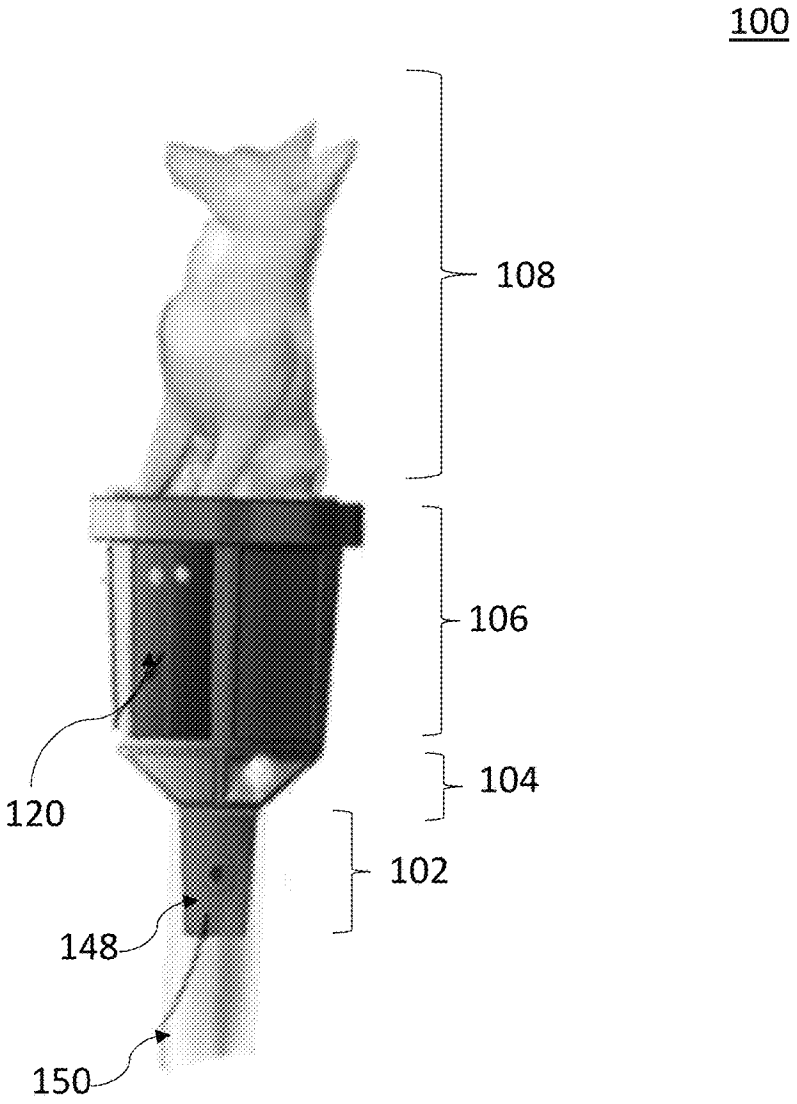
FIG. 13 depicts a perspective view of a schematic diagram of a finial assembly having a tapered mounting component, according to at least some embodiments disclosed herein.
Figure 14:
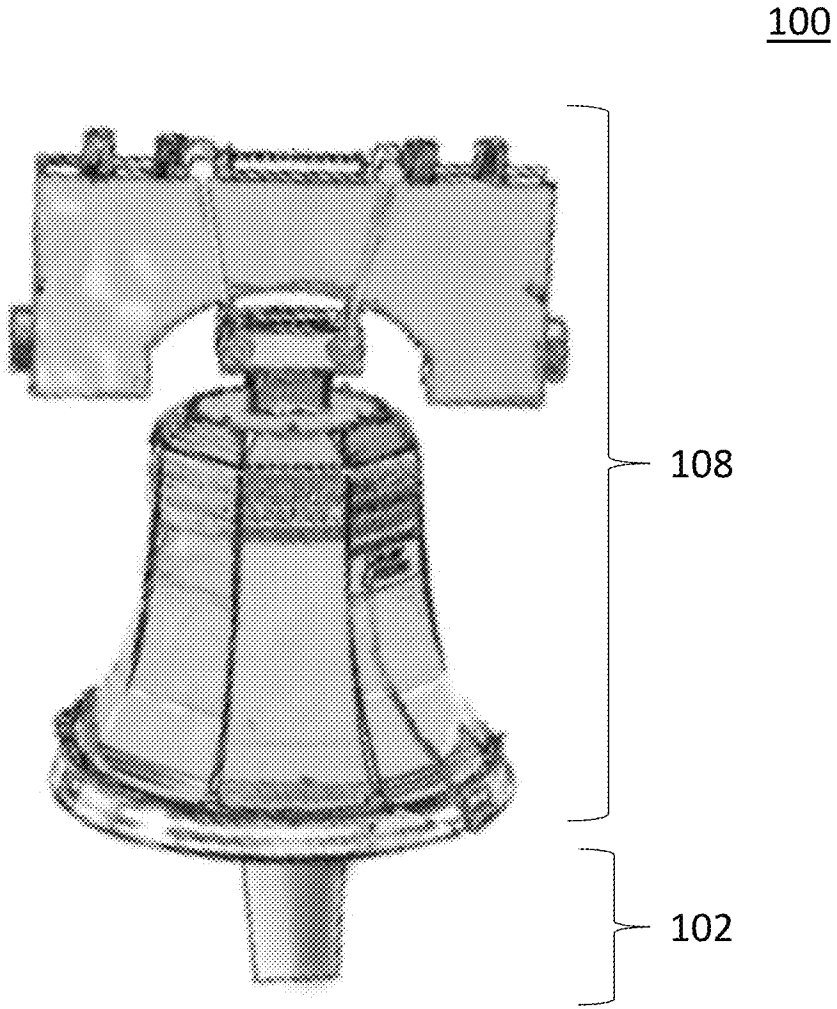
FIG. 14 depicts a perspective view of a schematic diagram of a first side of a finial assembly having a bell-shaped top component, according to at least some embodiments disclosed herein.

In some examples, the top component 108 resembles a flame shape (of FIG. 1-FIG. 9 and FIG. 11-FIG. 12) such that the finial assembly 100 resembles a torch. In further examples, the top component 108 resembles the State of Liberty's torch, which is used to light the way to freedom, showing individuals the path to liberty. In additional examples, the top component 108 resembles an animal figurine (such as a dog, a cat, a horse, a school mascot, etc.) (as depicted in FIG. 13) or a bell figurine (such as the Liberty Bell) (as depicted in FIG. 14 and FIG. 15). It should be appreciated that the shape of the top component 108 and the shape of the finial assembly 100 are not limited to the shapes depicted or described herein and other shapes are contemplated, such as a tree, a star, an animal, a bird, a golf ball, a baseball, a basketball, etc.

Figure 7:
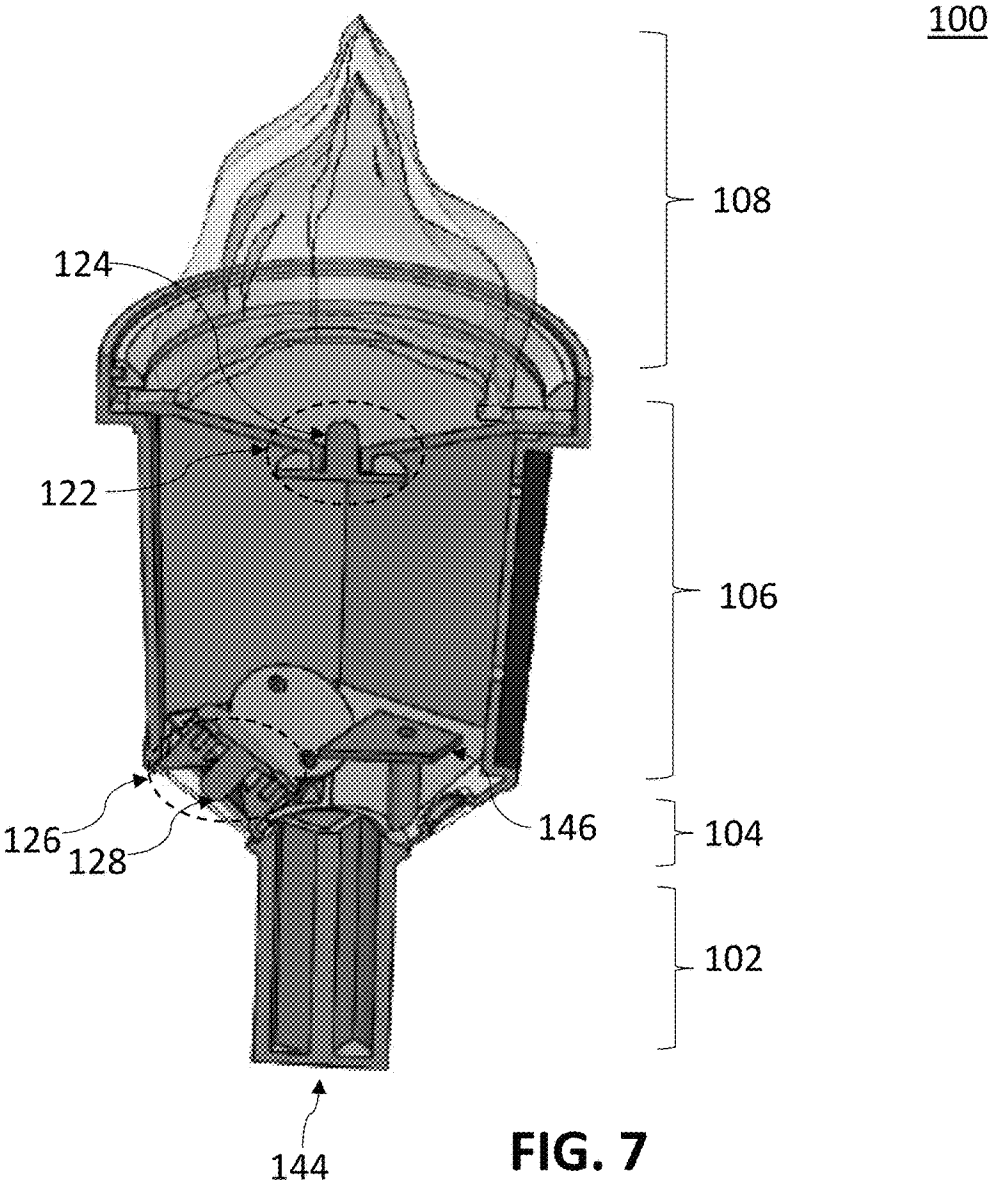
Figure 8:
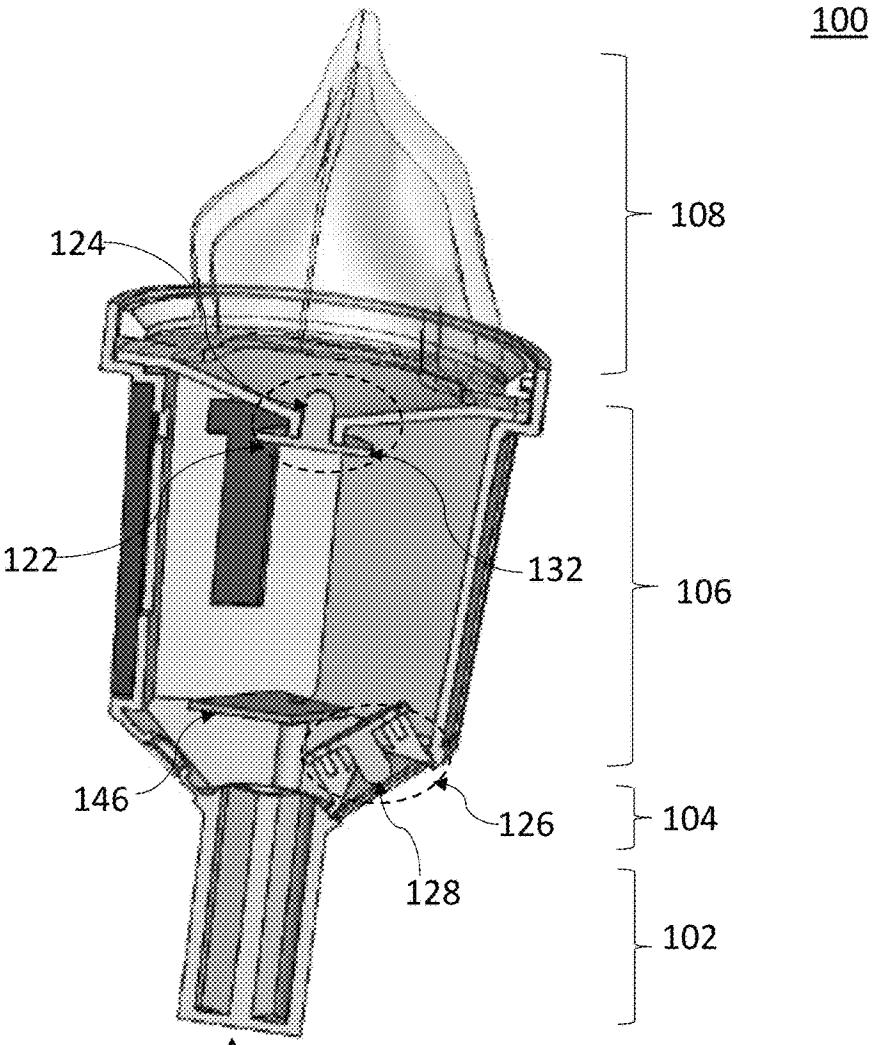
Figure 9:
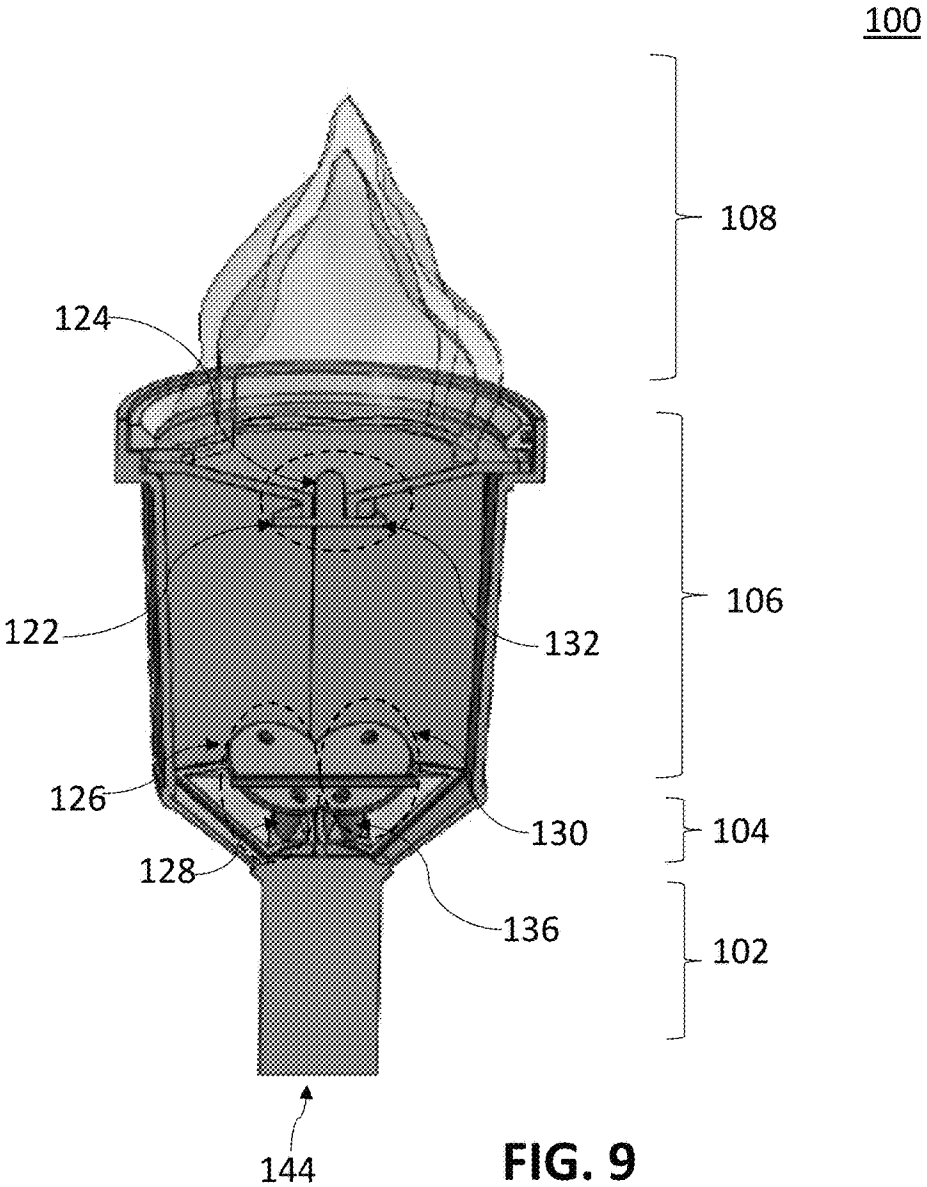
Figure 10:
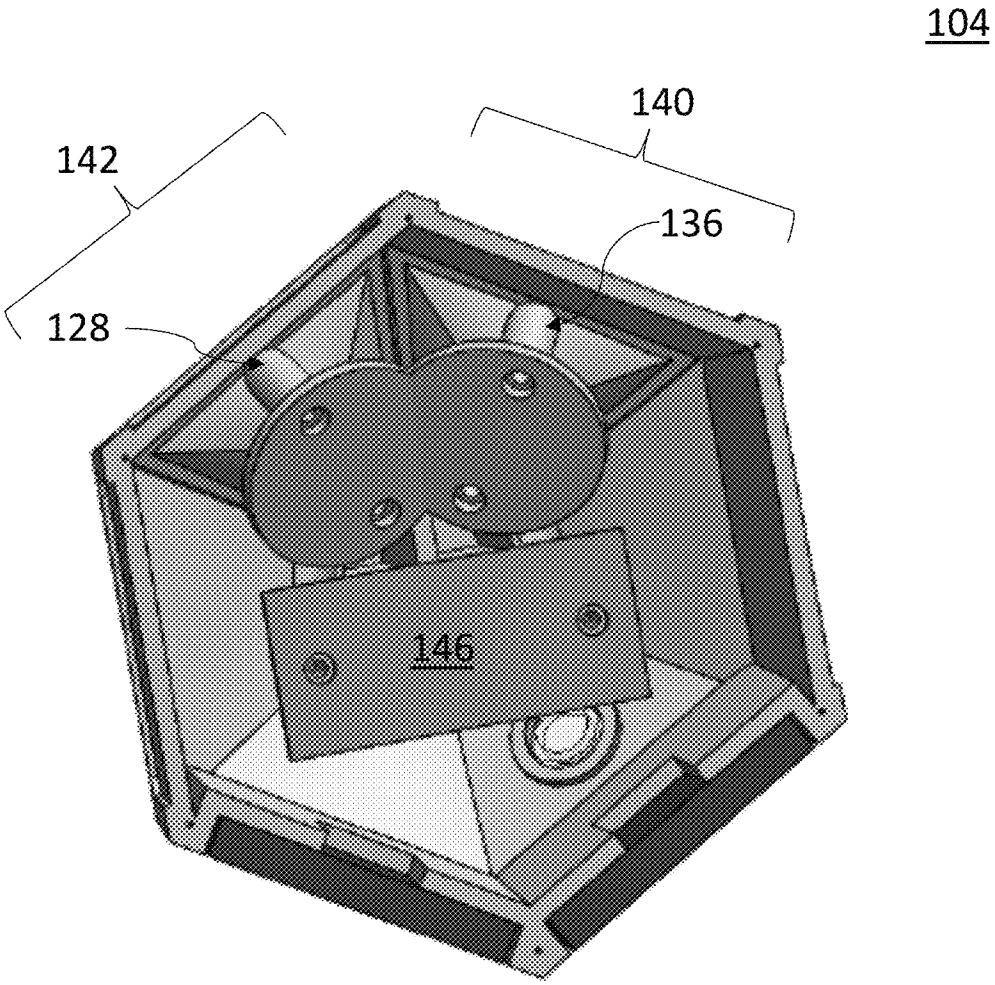
FIG. 10 depicts an interior view of a schematic diagram of a base component of a finial assembly, according to at least some embodiments disclosed herein.

The hollow interior of the body component 106 also includes a lower cavity configured to house at least a second support structure 126 (of FIG. 7, FIG. 8, and FIG. 9). A third support structure 130 (of FIG. 9) may also be included in the lower cavity of the hollow interior of the body component 106, in examples. As explained, the first support structure 122 supports the first LED 124. The first LED 124 is operatively connected to the at least one solar panel 120 of the body component 106. As depicted, the first support structure 122 may be planar in shape and may be configured perpendicular to the first LED 124. Similarly, the second support structure 126 supports the second LED 128 operatively connected to the at least one solar panel 120 of the body component 106. As depicted, the second support structure 126 may be planar in shape and may be configured perpendicular to the second LED 128. Further, the third support structure 130 may also include a third LED 136 operatively connected to the at least one solar panel 120 of the body component 106. As depicted, the third support structure 130 may be planar in shape and may be configured perpendicular to the third LED 136.

Figure 16:
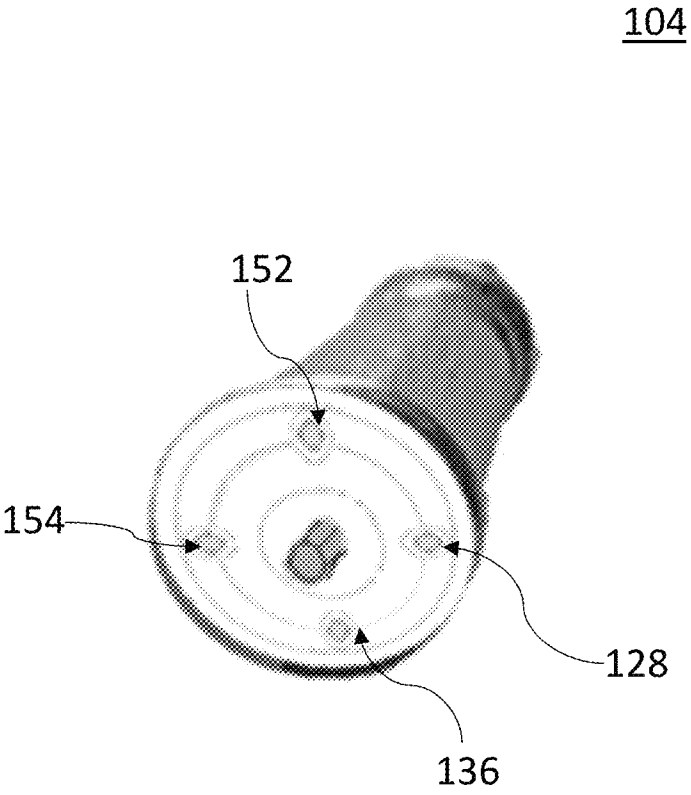
FIG. 16 depicts a bottom view of a schematic diagram of a base component of a finial assembly, according to at least some embodiments disclosed herein.

In another example as depicted in FIG. 16, the second LED 128, the third LED 136, a fourth LED 152, and a fifth LED 154 may be visible through a base of the base component 104 to illuminate the flag affixed to the flagpole 150.

A quantity of the first support structure 122, the second support structure 126, and the third support structure 130 is not limited to any particular quantity. In some examples, one support structure may be included in the lower cavity of the hollow interior of the body component 106 and one support structure may be included in the upper cavity of the hollow interior of the body component 106. In other examples, two support structures may be included in the lower cavity of the hollow interior of the body component 106 and one support structure may be included in the upper cavity of the hollow interior of the body component 106. In further examples, one support structure may be included in the lower cavity of the hollow interior of the body component 106 and two support structures may be included in the upper cavity of the hollow interior of the body component 106. The configurations of such support structures are non-limiting.

Moreover, the hollow interior of the body component 106 may also include at least one battery pack 146 (or accumulator) (of FIG. 6, FIG. 7, and FIG. 8) configured to accumulate electrical power from the at least one solar panel 120. The at least one battery pack 146 is operatively connected to the one or more LEDs (e.g., the first LED 124, the second LED 128, and the third LED 136).

In a further example, the hollow interior of the body component 106 may include a motion sensor (not shown) in connected communication with the one or more LEDs. The motion sensor may detect a presence of an animal or a human within a certain distance of the finial assembly 100. In response to such detection, the motion sensor may prompt the first LED 124 to turn on to illuminate the top component 104, flash the illumination towards the top component 104, change a color of illumination of the top component 104, increase a brightness of the illumination of the top component 104, or decrease a brightness of the illumination of the top component 104 for safety purposes or to warn of an intruder.

In examples, the first LED 124 associated with the first support structure 122 is configured to illuminate light towards the top component 108. Such illumination may be viewable through the clear or transparent top component 108 or the clear or transparent portion of the top component 108. In other examples, the second LED 128 associated with the second support structure 126 and/or the third LED 136 associated with the third support structure 130 are configured to illuminate light towards the one or more clear or transparent sections 140, 142 of the base component 105 to illuminate the flag. As such, the finial assembly 100 illuminates the flag during nighttime and illuminates the top component 104 or sculptured shape at the same time.

It should further be appreciated that the illumination of the flag and the illumination of the top component 104 may comprise one or more colors of illumination. In some examples, the color of illumination for the flag and the top component 104 may be identical. In other examples, the color of illumination for the flag and the top component 104 may differ. In further examples, the color of illumination for the flag and/or the top component 104 may change during a given period of time (e.g., every five minutes, every hour, etc.). In other examples, a brightness of the illumination of the flag and the illumination of the top component 104 may be increased or dimmed. Such modification of the color and brightness of the illumination of the flag and the top component 104 may occur via remote control or Wi-Fi.

Figure 2:
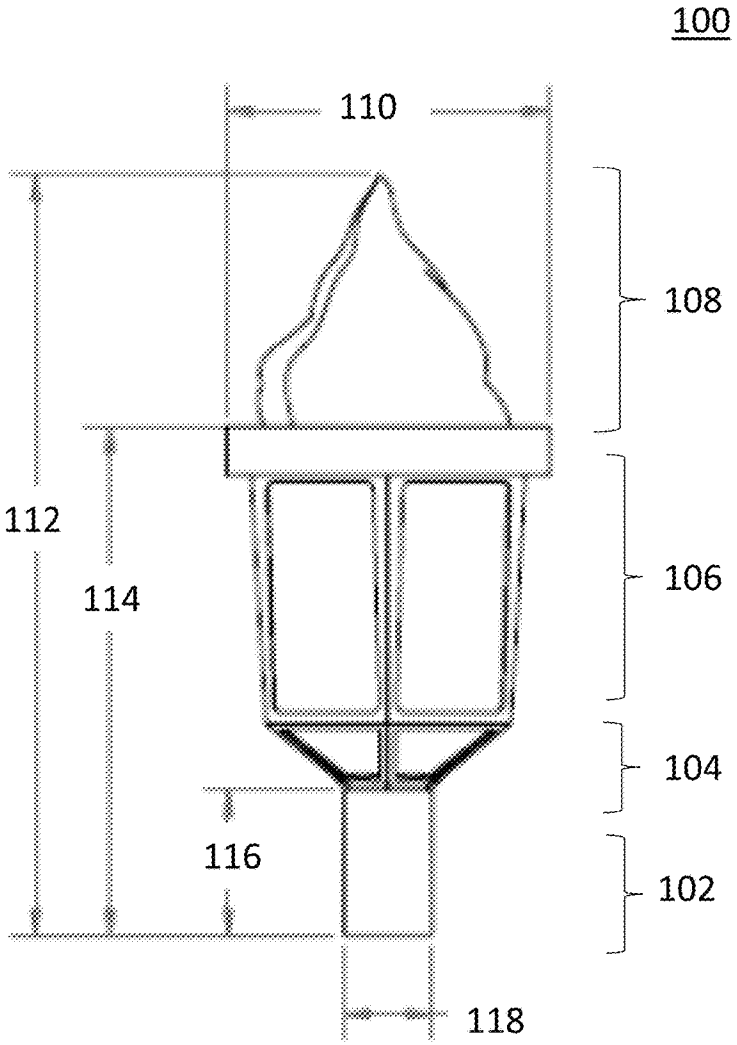
FIG. 2 depicts a perspective view of a schematic diagram of a finial assembly, according to at least some embodiments disclosed herein.
Figure 3:
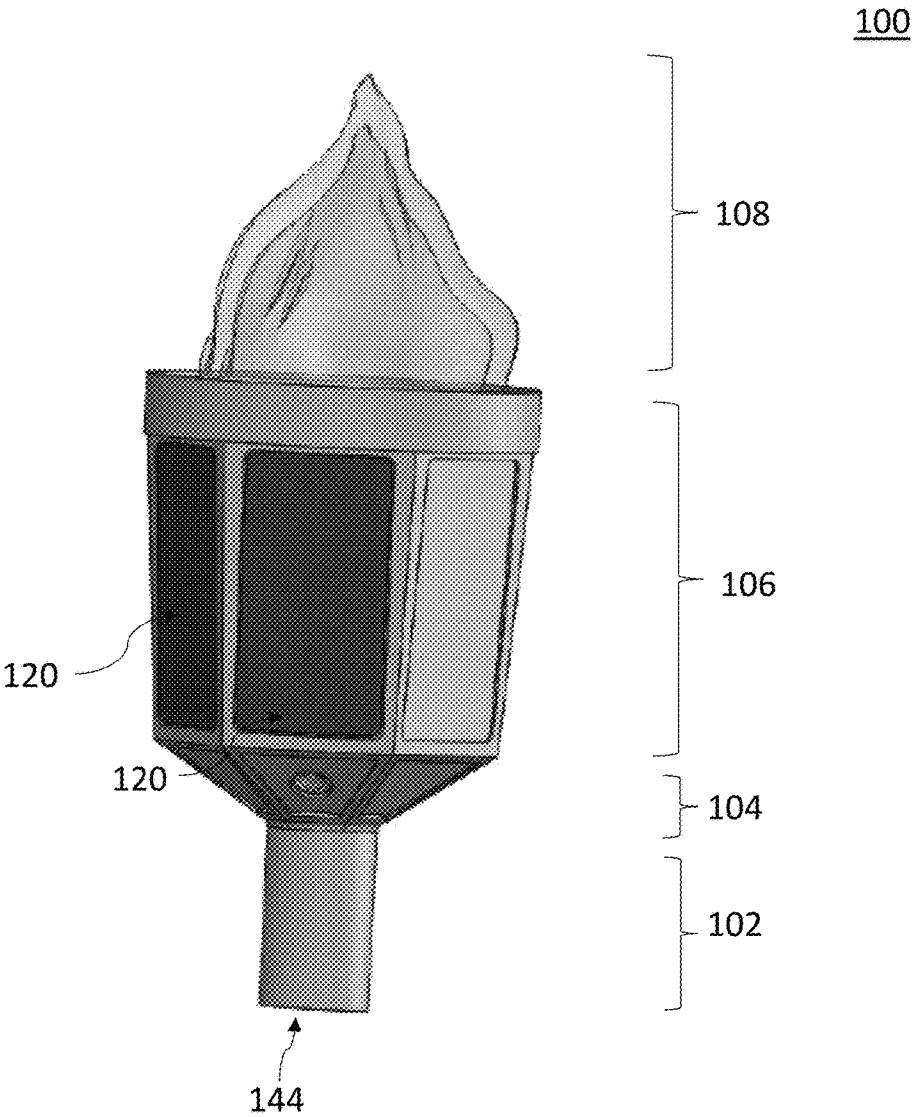
FIG. 3 depicts a perspective view of a schematic diagram of a finial assembly having at least one solar panel on a body component of the finial assembly, according to at least some embodiments disclosed herein.
Figure 4:
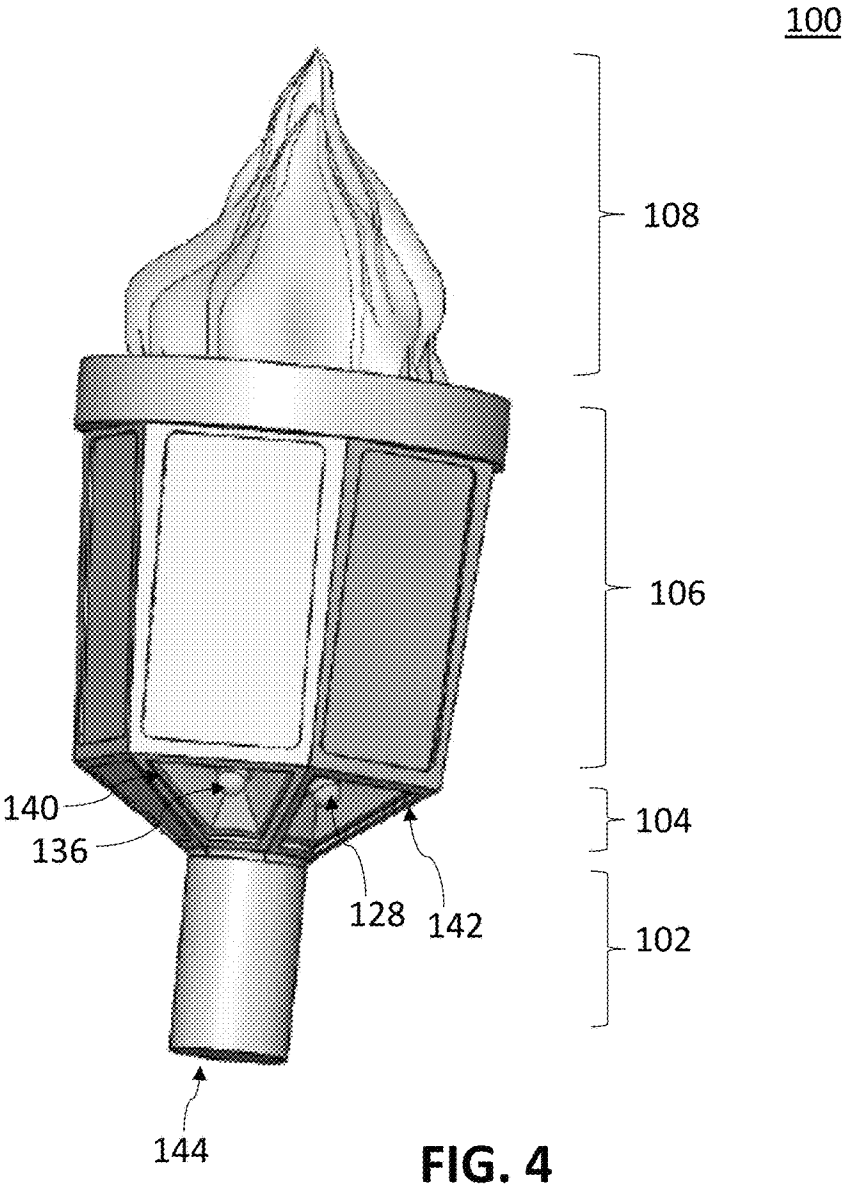
FIG. 4 depicts a perspective view of a schematic diagram of a finial assembly having one or more clear or transparent sections in a base component such that one or more light-emitting diodes (LEDs) housed within a body component illuminate a flag affixed to a flagpole, according to at least some embodiments disclosed herein.
Figure 5:
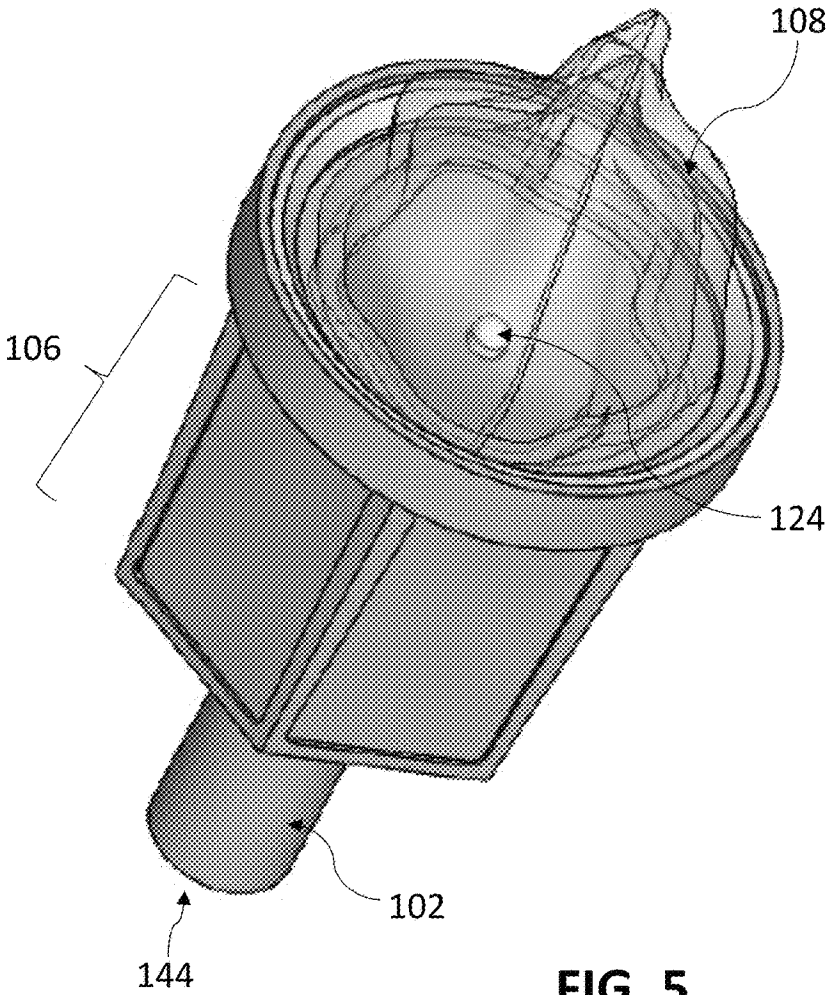
FIG. 5 depicts a perspective view of a schematic diagram of a finial assembly having a top component comprising a clear or transparent portion such that one or more LEDs housed within a body component illuminate light towards the top component, according to at least some embodiments disclosed herein.
Figure 6:
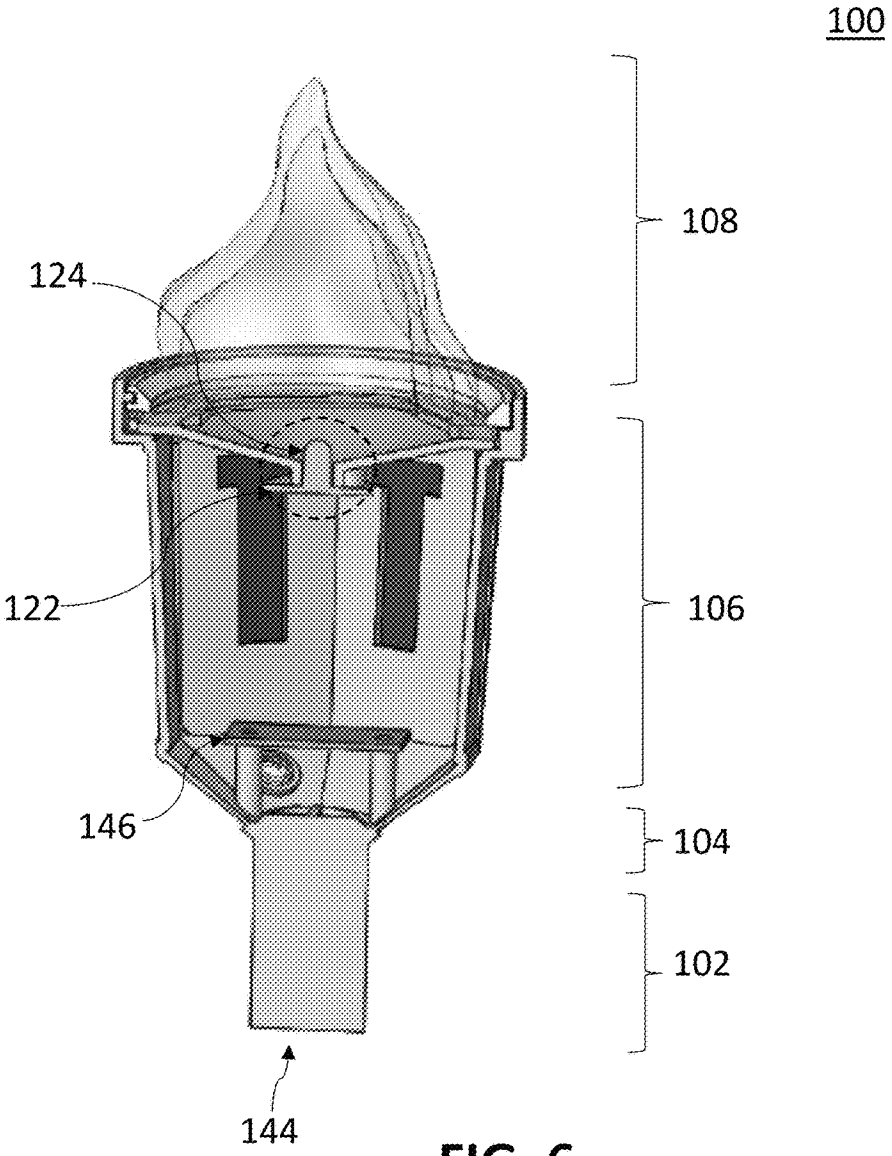
FIG. 6-FIG. 9 depict cross-sectional views of a schematic diagram of a finial assembly, according to at least some embodiments disclosed herein.

Various dimensions of an example finial assembly 100 are depicted in FIG. 2. A width 110 of the top component 108 is approximately 3.250 inches. A length 112 of the finial assembly 100 from the mounting component 102 to the top component 108 is approximately 7.645 inches. A length 114 of the finial assembly 100 from the mounting component 102 to the body component 106 is approximately 5.125 inches. A height 116 of the mounting component 102 of the finial assembly 100 is approximately 1.462 inches. A width 118 of the mounting component 102 of the finial assembly 100 is approximately 0.900 inches. It should be appreciated that these dimensions are provided for illustrative purposes only and other dimensions and configurations are contemplated.

The examples provided herein describe the finial assembly 100 being affixed to the flagpole 150 and being configured to illuminate the flag affixed to the flagpole 150. It should be appreciated hat the finial assembly 100 may be affixed to other objects besides the flagpole 150 via similar means, such as a fence post to light a fence and/or an object adjacent a pathway to light a walkway or a driveway, among other examples. Moreover, in some embodiments, the at least one solar panel 120 may be replaced such that the finial assembly 100 utilizes wiring from an electrical system (such as a home electrical system) to illuminate the flag (or other object), while illuminating the top component 104. In other examples, the finial assembly 100 may be mounted to any wall-mounted pole, instead of the flagpole 150.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others or ordinary skill in the art to understand the embodiments disclosed herein.

When introducing elements of the present disclosure or the embodiments thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A finial assembly affixed to a flagpole and configured to illuminate a flag affixed to the flagpole, the finial assembly comprising:

a mounting component comprising an opening, the opening being configured to receive the flagpole therein and affix the finial assembly to the flagpole;

a base component positioned between a body component and the mounting component, the base component radiating outward from the mounting component;

the body component positioned between the base component and a top component, the body component comprising:

at least one solar panel;

an exterior surface disposed opposite an interior surface; and a hollow interior comprising:

an upper cavity configured to house a first support structure and configured to receive the top component; and a lower cavity configured to house a second support structure; wherein the too component is clear or transparent and a first LED associated with the first support structure is configured to illuminate light towards the top component, and one or more second LEDs associated with the second support structure are configured to illuminate light towards one or more clear or transparent sections of the base component to illuminate the flag.

2. The finial assembly of claim 1, wherein an angle between the mounting component and the base component is an obtuse angle.

3. The finial assembly of claim 1, wherein a width of the mounting component is less than a width of the body component.

4. The finial assembly of claim 1, wherein the LEDs of the first support structure and the second support structure are operatively connected to the at least one solar panel of the body component.

5. The finial assembly of claim 4, wherein the hollow interior of the body component further comprises: at least one battery pack configured to accumulate electrical power from the at least one solar panel, wherein the at least one battery pack is operatively connected to the LEDs.

6. The finial assembly of claim 1, wherein a shape of each of the base component and the body component is a hexagonal shape, and wherein each of the base component and the body component comprise six walls.

7. The finial assembly of claim 1, wherein the top component is seated in the upper cavity of the body component.

8. The finial assembly of claim 1, wherein the top component comprises a glass material or a translucent thermoplastic material.

9. A finial assembly affixed to a flagpole and configured to illuminate a flag affixed to the flagpole, the finial assembly comprising:

a mounting component comprising an opening, the opening being configured to receive the flagpole therein and affix the finial assembly to the flagpole;

a base component positioned between a body component and the mounting component, the base component comprising one or more clear or transparent sections and being configured to radiate outward from the mounting component;

the body component positioned between the base component and a top component, the body component comprising:

at least one solar panel;

an exterior surface disposed opposite an interior surface; and a hollow interior comprising:

an upper cavity configured to house a first support structure and configured to receive the top component; and a lower cavity configured to house a second support structure, wherein each of the first support structure and the second support structure comprise one or more light-emitting diodes (LED) operatively connected to the at least one solar panel of the body component; the top component comprising at least one clear or transparent portion; wherein a first LED associated with the first support structure is configured to illuminate light towards the too component and a second LED associated with the second support structure is configured to illuminate light towards the base component to illuminate the flag.

10. The finial assembly of claim 9, wherein the hollow interior of the body component further comprises:

at least one battery pack configured to accumulate electrical power from the at least one solar panel, wherein the at least one battery pack is operatively connected to the one or more LEDs.

11. The finial assembly of claim 9, wherein a shape of each of the base component and the body component is a hexagonal shape, and wherein each of the base component and the body component comprise six walls.

12. The finial assembly of claim 1, wherein the top component comprises a glass material or a translucent thermoplastic material.

13. A finial assembly affixed to a flagpole and configured to illuminate a flag affixed to the flagpole, the finial assembly comprising:

a mounting component comprising an opening, the opening being configured to receive the flagpole therein and affix the finial assembly to the flagpole;

a base component positioned between a body component and the mounting component, the base component having a hexagonal shape and comprising one or more clear or transparent sections and being configured to radiate outward from the mounting component;

the body component positioned between the base component and a top component, the body component having the hexagonal shape and comprising:

at least one solar panel;

an exterior surface disposed opposite an interior surface; and a hollow interior comprising:

an upper cavity configured to house a first support structure and configured to receive the top component; and a lower cavity configured to house a second support structure and at least one battery pack, wherein the at least one battery pack is configured to accumulate electrical power from the at least one solar panel, wherein the at least one battery pack is operatively connected to one or more LEDs, and wherein each of the first support structure and the second support structure comprise the one or more LEDs operatively connected to the at least one solar panel of the body component; and the top component comprising at least one clear or transparent portion; wherein one of the LEDs associated with the first support structure is configured to illuminate light towards the too component, and wherein at least one of the LEDs associated with the second support structure is configured to illuminate light towards the base component to illuminate the flag.

* * * * *